US007200940B2

(12) United States Patent
MacKelvie

(10) Patent No.: US 7,200,940 B2
(45) Date of Patent: Apr. 10, 2007

(54) TOOL FOR SURFACE BURRING

(76) Inventor: Winston MacKelvie, Box 1156, Knowlton, Quebec (CA) J0E 1V0

( * ) Notice: Subject to any disclaimer, the term of this patent is extended or adjusted under 35 U.S.C. 154(b) by 160 days.

(21) Appl. No.: 10/916,090

(22) Filed: Aug. 11, 2004

(65) Prior Publication Data

US 2006/0032058 A1 Feb. 16, 2006

(51) Int. Cl.
*B26D 3/08* (2006.01)
*B27B 21/00* (2006.01)
*B28B 3/00* (2006.01)

(52) U.S. Cl. ..... 30/304; 30/502; 30/503.5; 83/875; 83/883

(58) Field of Classification Search ..... 30/304, 30/501, 502, 503, 503.5; 29/557; 83/15, 83/883, 875; 118/35–43
See application file for complete search history.

(56) References Cited

U.S. PATENT DOCUMENTS 5,376,410 A 12/1994 MacKelvie
6,431,331 B1 * 8/2002 Arbesman ..... 188/250 G
6,553,869 B1 4/2003 MacKelvie

FOREIGN PATENT DOCUMENTS

CA 1337622 11/1995

* cited by examiner

*Primary Examiner*—Timothy V. Eley
*Assistant Examiner*—Isaac N. Hamilton

(57) ABSTRACT

A tool for burring the surface of a material. The tool has two sets of oppositely facing toothed blades which are made to move towards each other when the tool is pressed against a surface. Each tooth planes a shallow groove into the surface which results in hook-like burrs or planings rising from each groove. Limiters on the blade stroke ensure that the raised burr is not severed. A spring returns the blades to their start position. The resulting surface therefore has a plurality of shallow, non-piercing stopped grooves with a like plurality of hook-like burrs. Such a modified surface provides increased surface area for electrochemical activity, and a mechanical grip to materials bonded thereto. The tool uses replaceable blade packs which snap into a permanent tool housing. The tool may be operated with a simple hammer blow or it may be rapidly driven into large or small areas of a surface by a manual and/or computer directed punch press.

5 Claims, 1 Drawing Sheet

2a
7a
1a
5a
3a
4a
5b
1b
7b
3b
2b
4b 6a
5
2b
1b
1a
2a
4a,b 6b
8a
8
8b
7

1c
2a,b
1a
1b
1a
1b 8a,b
8
5

7
9a,b
8
1a
1b
1a
1b 1d
9a
8a
5
8b
9b
8
1a
1b
4a,b 5
1a 5
1a 15
1e
12
11
11a
10
14c
14b
14a
15a
9a
13a
13b
25
8
1a,b
4a,b
6c 31
30

31
30

12
10
13b
9a,b
25
8
25

12
31
30
21

12
40
20
22
21
21

TOOL FOR SURFACE BURRING

BACKGROUND OF THE INVENTION

U.S. Pat. No. 5,376,410 to the present applicant disclose a process for modifying the surface of a material to which the present invention pertains. Canadian patent # 1,337,622 also to the present applicant discloses a generic tool to effect the process. U.S. Pat. No. 6,553,869 also by the present applicant discloses a method of fabricating toothed blades for such a tool. The present invention discloses an improvement to this tool with structures offering ease of manufacture, assembly and use.

SUMMARY OF THE INVENTION

A blade pack comprises two sets or rows of toothed blades arranged in opposing directions. Aligned holes in each blade set or row have an actuator rod to move the blades. Identical notches in the blades align to create a common cavity to hold a spring to return blades to a start position. The blades and spring are inserted into a channel-shaped clip. The elongated slots in the clip align with the blade holes and taper-ended alignment pins are inserted which cause a slight compression of the spring. By clamping the aligned clip and blades together, the tapered pins can be removed and replaced by two permanent actuator rods inserted through the clip and blade holes. Proper dimensioning of blades, spring, and clip, allows the spring to force the rods apart and against the end of the slots in the clip thereby creating a secure assembly that allows handling without parts falling out.

Such blade packs can be standardized as to size and tooth design.

A tool body comprises a channel shaped structure into which the blade set or pack fits. The sides of the tool have angled slots to receive the actuator rods. Shallow notches at the start of the angled slots provide a ledge for the rods to snap-fit into providing a retention force yet allowing easy insertion and removal of the blade pack. When the tool is pressed against the surface to be modified, the actuator rods ride the slots upwards and towards each other moving the blades. The blade's movement causes each blade's teeth to dig into the surface and together cut or plane a plurality of short, stopped grooves. This raises a like plurality of planed chips, or burrs, which are not severed but rather are allowed to remain firmly attached to one end of the respective groove from which it came.

To make such a process cost-effective, the tool that does the processing must have low-cost blades that are easily replaceable when dull. The present invention discloses such a tool for modifying a generally planar surface of a work piece, comprising first and second sets of blades, each blade comprising a generally planar blade member having a body portion and a plurality of teeth at the bottom of said body portion, said teeth presenting a cutting edge at a planing angle to a surface, said first set of blades having teeth extending in a first longitudinal direction, said second set of blades extending in an opposite longitudinal direction; biasing means urging said first set of blades apart from said second set of blades in the longitudinal axis direction; a retaining member for retaining said blades in a side by side relationship and for retaining said biasing means; a first actuator extending through said retaining member and through said body portions of said first set of blades; a second actuator extending through said retaining member and through said body portions of said second set of blades; and a housing member designed to receive said blades and actuators, and to present said blades to a surface requiring said modification; said housing member having means for guiding said actuators such that upon a force being exerted on said housing member, said actuators cause said blades to move in opposite directions and thereby causing said teeth to plow into said surface.

DETAILED DESCRIPTION

Figures 1, 2, 3, 4, 5, 6, 7, 8, 8A, 9, 10, 11, 12, 13, 14:
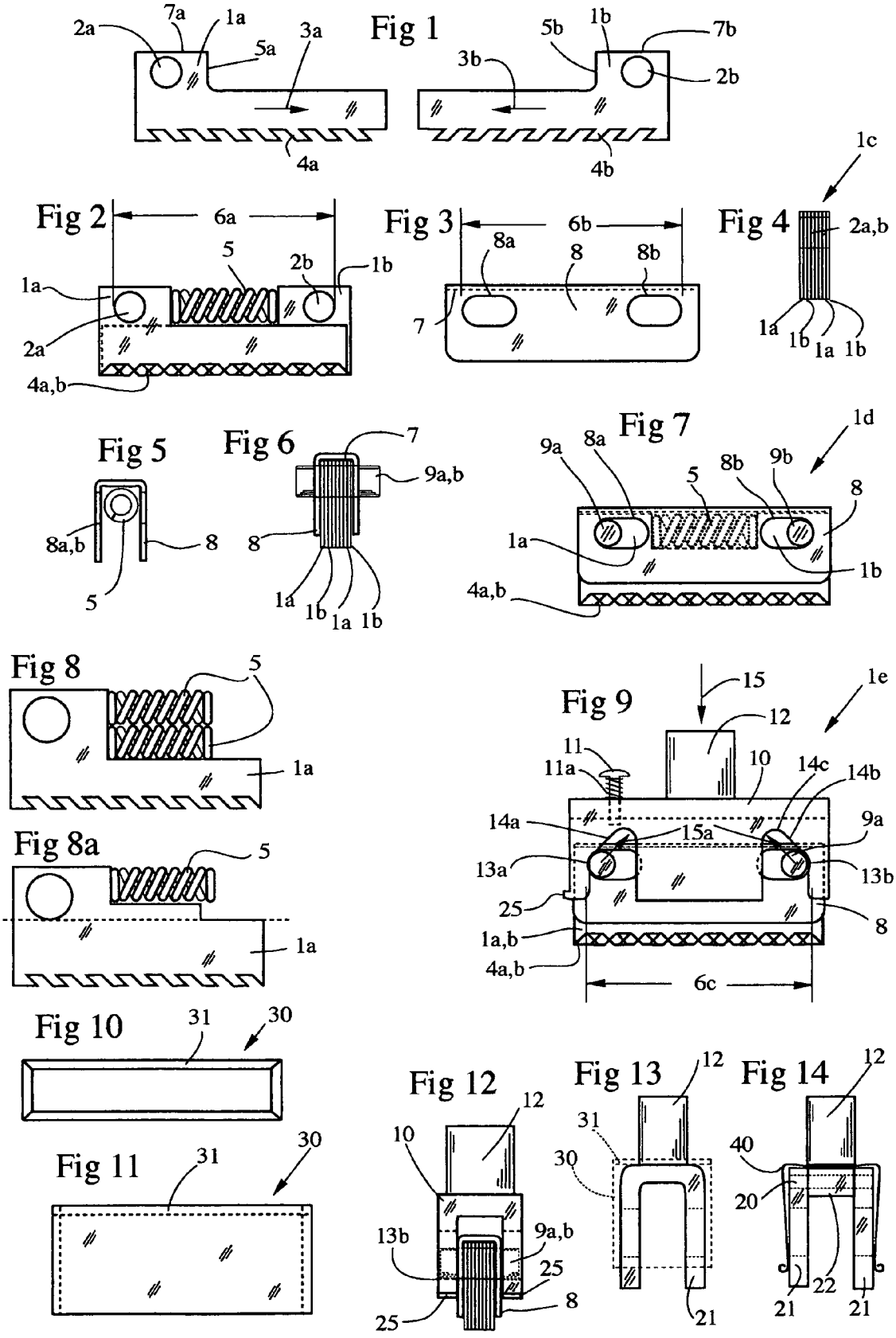
FIG. 1 shows two sets of opposing toothed blades.
FIG. 2 shows the opposing blades interdigitated and brought into starting position with holes and notches aligned and with a return spring urging the blades apart.
FIG. 3 shows a side view of the blade clip with elongated holes or slots for the rods
FIG. 4 shows an end view of the interdigitated blades of FIG. 2.
FIG. 5 shows an end view of the blade clip with spring.
FIG. 6 shows the blade pack assembly with blade clip retaining member enclosing blades and spring (biasing means) and with actuator rods extending out of each side.
FIG. 7 shows a side view of the same embodiment with the spring shown in phantom form.
FIG. 8 shows how double springs can be incorporated.
FIG. 8*a* shows a double notched blade where fewer or thinner blades requires the use of a spring that is too small in diameter to rest on the deeper notch.
FIG. 9 shows the complete assembled tool with tool housing member enclosing blade set or pack.
FIG. 10 shows a top view of a flanged, slide-on sheath to retain actuator rods.
FIG. 11 shows a side view of the same embodiment.
FIG. 12 shows an end view of the embodiment of FIG. 9 where the tool housing member is machined or formed from a solid block.
FIG. 13 shows an end view of a different embodiment of the tool housing member where the channel-shaped tool body is formed by folding bar stock.
FIG. 14 shows another embodiment where the tool housing member is assembled from three components and where a spring element encloses three sides of the tool and is used to retain the actuator rods in the tool body and allows the replacement of the blade pack assembly.

In FIG. 1 identical blades are shown as being a left hand blade 1*a* and a right hand blade 1*b*. There could be any number of such blades in a blade set 1*c*. For example eight are shown in in the blade set of FIGS. 4, 6, 12. Normally half the blades would be left hand 1*a* and half right hand 1*b*. The blades have teeth 4*a*, 4*b*, actuator holes 2*a*, 2*b*, notch 5*a*, 5*b*, and top surfaces 7*a*, *b*. blades direction of cut are shown by arrows 3*a* and 3*b*. The blades are normally arranged in an interdigitated manner as in the FIG. 4 end view of the blade set showing alternative left hand 1*a* and right hand blades 1*b* forming the blade set 1*c*. Other assembly arrangements of the blade set are possible consistent with having equal number of each so as to achieve a desired cancellation of cutting forces. Otherwise the workpiece would have to be clamped to resist forces which would otherwise be greater in one cutting direction. For very special conditions it is possible to have unequal number of opposing blades where the blades are not identical as to thickness, tooth design and/or number. In such a case, although the left and right blades may be unequal in number, the total cutting forces in each direction should be approximately equal to eliminate work piece clamping requirements.

FIG. 2 shows the interdigitated blade set with the notches 3*a, b* and holes 2*a, b* all aligned, and with a biasing means (spring) 5 nestled in the space created by the aligned notches. Actuator rods (rods) 9*a, b* (FIG. 6) slide through the aligned holes. The spring 5 keeps the blades apart and establishes a first dimension 6*b* representing the maximum distance between outside rod surfaces with blade notches 5*a*, 5*b* just touching spring 5, that is, with no compression of the spring. In FIG. 3 the blade retaining member (clip) 8 has elongated holes (slots) 8*a, b* where the dimension 6*b* is less that 6*a* by, say, 0.010 inch or 0.2 mm. By this means, when blades 1*a*, 1*b*, spring 5 and rods 9*a*, 9*b* are fitted in blade clip 8, the spring 5 must be slightly compressed resulting in rods 9*a, b* being forced against the ends of the slots 8*a*, 8*b*. By this means, all components are retained in the clip. Stated otherwise, pre-compression of the spring prevents the rods 9*a*, 9*b* from inadvertently falling out of the clip 8 during normal handling.

FIG. 5 shows an end view of the clip 8 showing slots 8*a*, 8*b* and how the spring straightness under compression is maintained by having it's diameter closely matching the blade clip 8 size. FIG. 6 shows the same view with blade set 1*c* and rods 9*a*, 9*b* installed and indicating how inner upper surface 7 is very close to blade pack top surface 7*a*, 7*b* and thereby serves to hold blades substantially parallel to clip.

FIG. 7 shows a completed blade set 1*d* where the spring 5, notch walls 5*a*, 5*b*, and blade top surfaces 7*a*, 7*b* are all shown in dotted outline. Such replaceable blade sets can be made in standard sizes. They may be throwaway or may be disassembled for sharpening.

Where a material to be processed is 'sticky' and/or the cuts are deep, an additional spring, or other biasing means such as urethane blocks, may easily be accommodated by deepening the notch to hold two or more springs as shown in FIG. 8. In large blade sets springs may also be mounted side by side (not shown). In small blade sets where the width of the assembled blades requires a spring that is too small in diameter to rest on the deep notch, a double notch design provides spring support neat the blade's hole end. The deeper notch to clear the opposing actuator rod being only at the other end of the blade as shown in FIG. 8*a*.

FIG. 9 shows a complete tool 1*e* which has a generally channel shape housing member (tool body) 10. Both sides of the tool body 10 have rod guiding means such as angled slots 14*a*, 14*b* open at the bottom to enable actuator rods 9*a*, 9*b* to engage slots 14*a*, 14*b*. In FIG. 9 arrows 15*a* indicates the direction the rods 9*a*, 9*b* travel when force 15 is applied to mounting stub 12. (Stub 12 may have threads, grooves, hammer surface or other means to adapt to presses and impactors.) The limit of slots is shown as 14*c*. Slot notches 13*a*, 13*b* define a distance 6*c* which is less that 6*b* by, say, 0.010" or 0.2 mm. These notches 13*a*, 13*b* provide a retaining means for rods 9*a*, 9*b* and therefore for the blade pack 1*d*. Rods 9*a*, 9*b* will 'snap' into the notches by spring pressure and thereby prevent blade pack 1*d* from accidentally falling out of the tool 1*e*. Thumb pin 11 and spring 11*a* form a simple method of ejecting blade set 1*d* from tool 1*e*.

This one piece housing member or tool body 1*e* can be machined from a solid block in two operations, the first with a pair of shaped cutters to crosswise mill the two angled slots followed by the second using a plain slotting cutter to longitudinally mill the channel.

Four tabs 25 of which only one is shown in FIG. 9 and two in FIG. 12, may be formed at the four corners of the housing member 10 to retain a sleeve 30 shown in FIG. 11. The sleeve 30 in FIGS. 10, 11 just drops down over housing member 10 and rests on tabs 25. In another embodiment the sleeve 30 has inwardly formed flanges 31 that test on top of tool body 10 as shown in dotted outline in FIG. 13.

FIG. 13 and 14 show alternate methods of fabricating the housing member where FIG. 13 shows a one piece housing member 21 formed by folding bar stock into a channel and FIG. 14 shows a three piece housing member comprising two identical side 21 and a bridge 22 joined together by rivets or other fasteners 20. In these embodiments the sides to be slotted and notched are flat to begin with and therefore the angled slots and notches can be formed using a punch and die. FIG. 14 also shows a spring clamp 40 on housing member 10 to retain actuator rods 9*a* yet allow easy replacement of blade pack 1*d*.

The invention claimed is:

1. An apparatus for modifying a generally planar surface of a work piece, said apparatus comprising:

first and second rows of blades, each blade comprising a generally planar blade member having a body portion and a plurality of teeth at the bottom of said body portion, said teeth presenting cutting edges to a surface, said first row of blades having teeth extending in a first longitudinal direction, said second row of blades having teeth extending in an opposite longitudinal direction;

biasing means urging said first row of blades apart from said second row of blades in the longitudinal axis direction;

a first actuator extending through a retaining member and through said body portions of said first row of blades;

a second actuator extending through said retaining member and through said body portions of said second row of blades;

said retaining member having a pair of side walls juxtaposed with the outer blades of said first and second rows of blades, for retaining said rows of blades in a side by side relationship and for retaining said biasing means, each of said side walls having longitudinally extending slots formed therein to receive said first and second actuators; and a housing member designed to receive said blades, said retaining member, and said first and second actuators, said housing member having means for guiding said actuators such that upon a force being exerted on said housing member, said actuators cause said blades to move in opposite directions.

2. The apparatus of claim 1 wherein each of said actuators comprises a cylindrical member.

3. The apparatus of claim 1 wherein each of said means for guiding said actuators comprises a lower vertical portion and an upper inwardly extending portion.

4. The apparatus of claim 1 wherein said biasing means comprises a spring member, said spring member being mounted between and urging said body portions of said first row of blades from said body portions of said second row of blades.

5. The apparatus of claim 4 wherein said spring member further urges said first and second actuators against respective opposite ends of said longitudinally extending slots.

* * * * *